US010422254B2

(12) United States Patent
Asahi et al.

(10) Patent No.: US 10,422,254 B2
(45) Date of Patent: Sep. 24, 2019

(54) VARIABLE VALVE TIMING CONTROL DEVICE

(71) Applicant: AISIN SEIKI KABUSHIKI KAISHA, Kariya-shi, Aichi-ken (JP)

(72) Inventors: Takeo Asahi, Kariya (JP); Yuji Noguchi, Obu (JP); Tomohiro Kajita, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 15/898,699

(22) Filed: Feb. 19, 2018

(65) Prior Publication Data

US 2018/0238201 A1 Aug. 23, 2018

(30) Foreign Application Priority Data

Feb. 23, 2017 (JP) ..... 2017-032220

(51) Int. Cl.

*F01L 1/34* (2006.01)
*F01L 1/344* (2006.01)
*F01L 1/047* (2006.01)

(52) U.S. Cl.

CPC ..... *F01L 1/3442* (2013.01); *F01L 2001/0476* (2013.01); *F01L 2001/3443* (2013.01); *F01L 2001/3444* (2013.01); *F01L 2001/34433* (2013.01); *F01L 2001/34446* (2013.01); *F01L 2001/34456* (2013.01); *F01L 2001/34463* (2013.01); *F01L 2001/34469* (2013.01); *F01L 2001/34483* (2013.01); *F01L 2250/02* (2013.01)

(58) Field of Classification Search

CPC ..... F01L 1/3442; F01L 2001/34433; F01L 2001/3443; F01L 2001/34463; F01L 2001/0476; F01L 2001/34446; F01L 2001/34456; F01L 2001/34469; F01L 2001/34483; F01L 2001/3444; F01L 2250/02

See application file for complete search history.

(56) References Cited

U.S. PATENT DOCUMENTS 5,931,126 A 8/1999 Eguchi et al.
2016/0230614 A1 8/2016 Scheidig et al.

FOREIGN PATENT DOCUMENTS

DE 10 2014 207 989 A1 10/2015
JP H09-177519 A 7/1997
JP 2001-200709 A 7/2001
JP 2016-044652 A 4/2016

*Primary Examiner* — Zelalem Eshete
(74) *Attorney, Agent, or Firm* — Buchanan Ingersoll & Rooney PC

(57) ABSTRACT

A variable valve timing control device includes a drive-side rotational body, a driven-side rotational body, a connecting bolt being coaxially disposed with a rotary axis and connecting the driven-side rotational body to a camshaft, a valve unit including a spool being disposed at an inner space of the connecting bolt and supplying and discharging a fluid to and from an advanced-angle chamber and a retarded-angle chamber, the valve unit discharging the fluid from an opening of a head portion of the connection bolt when the spool controls the fluid, and a reservoir being coaxially disposed with the rotary axis that is positioned laterally, the reservoir accumulating the fluid discharged from the opening of the head portion from which the fluid is configured to be sucked.

4 Claims, 7 Drawing Sheets

VARIABLE VALVE TIMING CONTROL DEVICE

CROSS REFERENCE TO RELATED APPLICATIONS

This application is based on and claims priority under 35 U.S.C. § 119 to Japanese Patent Application 2017-032220, filed on Feb. 23, 2017, the entire content of which is incorporated herein by reference.

TECHNICAL FIELD

This disclosure generally relates to a variable valve timing control device.

BACKGROUND DISCUSSION

A known technology as a variable valve timing control device is disclosed in JPH09-177519A (hereinafter referred to as Patent reference 1). According to Patent reference 1, the variable valve timing control device (a variable valve timing control mechanism in Patent reference 1) is disposed such that a part thereof is submerged at an operating fluid reservoir being provided at a cylinder head of an internal combustion engine.

In Patent reference 1, an advanced-angle chamber and a retarded-angle chamber (a first oil hydraulic chamber and a second oil hydraulic chamber in Patent reference 1) are formed by a vane that defines each of plural pressure chambers. When the internal combustion engine stops, one of the advanced-angle chamber and the retarded-angle chamber that is submerged in the operating fluid reservoir inhibits the operating oil from leaking thereout.

A known technology including an oil hydraulic control valve selectively supplying operating oil to an advanced-angle chamber and a retarded-angle chamber is disclosed in JP2001-200709A (hereinafter referred to as Patent reference 2). The technology includes an operating oil reservoir accumulating the operating oil at a passage to which the operating oil is discharged when the operating oil is supplied to one of the advanced-angle chamber and the retarded-angle chamber from the oil hydraulic control valve.

In Patent reference 2, when a phase changes in a state where supply pressure of the operating oil is not sufficiently provided, air is inhibited from being sucked into one of the advanced-angle chamber and the retarded-angle chamber by returning the operating oil in the operating oil reservoir to one of the advanced-angle chamber and the retarded-angle chamber via the discharging passage.

In the variable valve timing control devices inhibiting the air from entering into one of the advanced-angle chamber and the retarded-angle chamber as disclosed in Patent reference 1 and Patent reference 2, for example, even in a case where the internal combustion engine that has stopped for a long time starts, air does not enter into one of the advanced-angle chamber and the retarded-angle chamber, and contact noise generated when a vane comes in contact with an end wall of the oil hydraulic chamber in a circumferential direction is inhibited from being generated.

Here, assuming variable valve timing control devices disclosed in JP2012-47228A and JP2012-57578A, each of configurations in which a valve is contained in a bolt connecting a driven side rotational body to a camshaft and in which the valve operates from an opening of a head portion of the bolt is adapted.

In each of the variable valve timing control devices disclosed in JP2012-47228A and JP2012-57578A having such a configuration, because a distance from the valve to one of the advanced-angle chamber and the retarded-angle chamber is short, a control having an enhanced responsiveness is achieved. However, in the variable valve timing control device having this configuration, because the opening of the head portion of the bolt corresponds to a drain portion discharging fluid from the valve, air may be sucked from the head portion of the bolt by a negative pressure generated at one of the advanced-angle chamber and the retarded-angle chamber, and may enter in one of the advanced-angle chamber and the retarded-angle chamber, in a case where the phase displaces in a state where the fluid is not sufficiently provided.

In a case where the air is sucked into one of the advanced-angle chamber and the retarded-angle chamber, the vane may generate contact noise, which is an issue described in Patent reference 1 and Patent reference 2.

A need thus exists for a variable valve timing control device which is not susceptible to the drawback mentioned above.

SUMMARY

According to an aspect of this disclosure, a variable valve timing control device includes a drive-side rotational body rotating synchronously with a crankshaft of an internal combustion engine, a driven-side rotational body being coaxially disposed with a rotary axis of the drive-side rotational body and rotating integrally with a camshaft, a connecting bolt being coaxially disposed with the rotary axis and connecting the driven-side rotational body to the camshaft, a valve unit including a spool being disposed at an inner space of the connecting bolt and supplying and discharging a fluid to and from an advanced-angle chamber and a retarded-angle chamber that are disposed between the drive-side rotational body and the driven-side rotational body, the valve unit discharging the fluid from an opening of a head portion of the connection bolt when the spool controls the fluid, and a reservoir being coaxially disposed with the rotary axis that is positioned laterally, the reservoir accumulating the fluid discharged from the opening of the head portion from which the fluid is configured to be sucked.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments of the disclosure will be explained with reference to the drawings.

Figure 1:
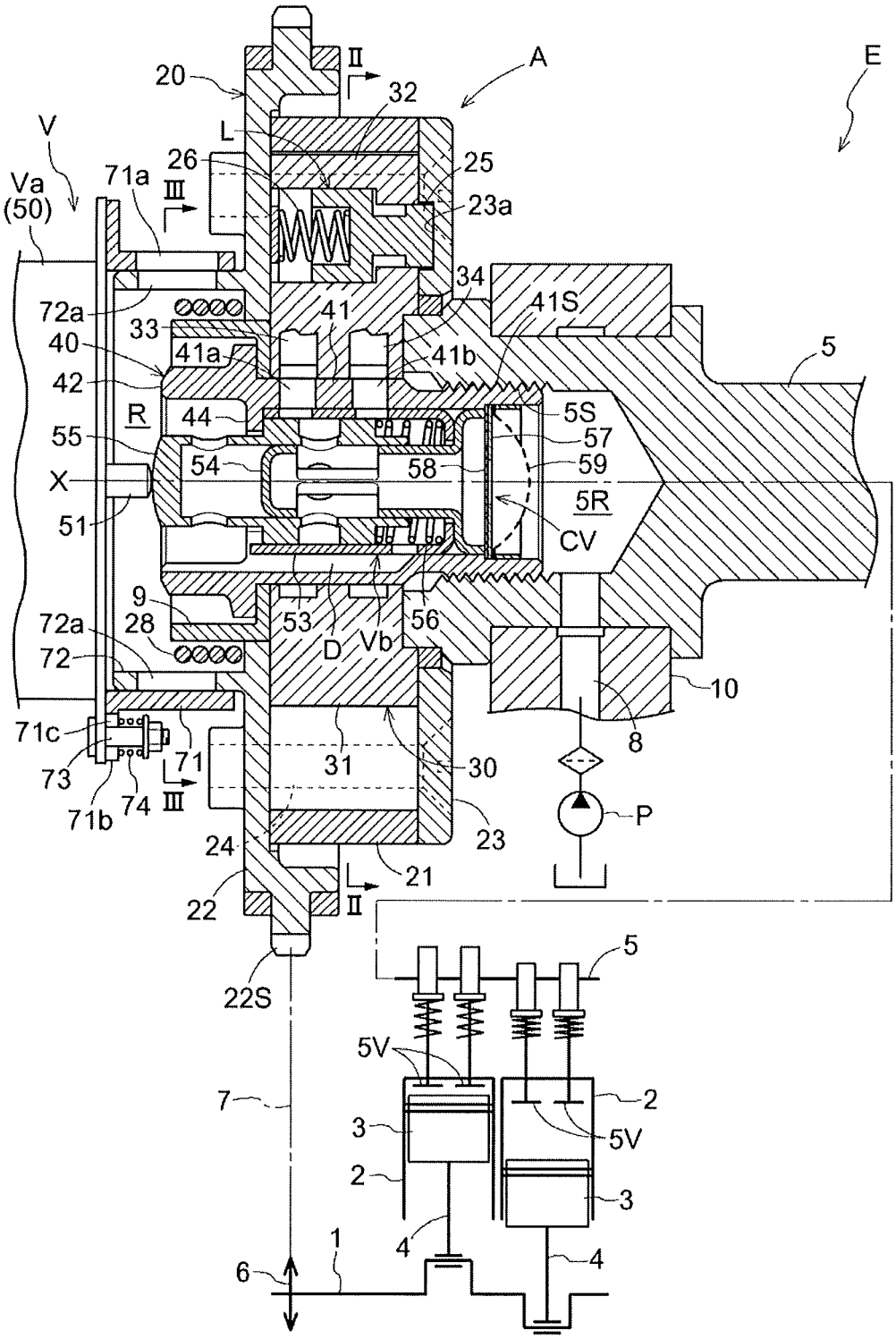
FIG. 1 is a cross sectional view illustrating an entire configuration of a variable valve timing control device according to a first embodiment disclosed here.
Figure 2:
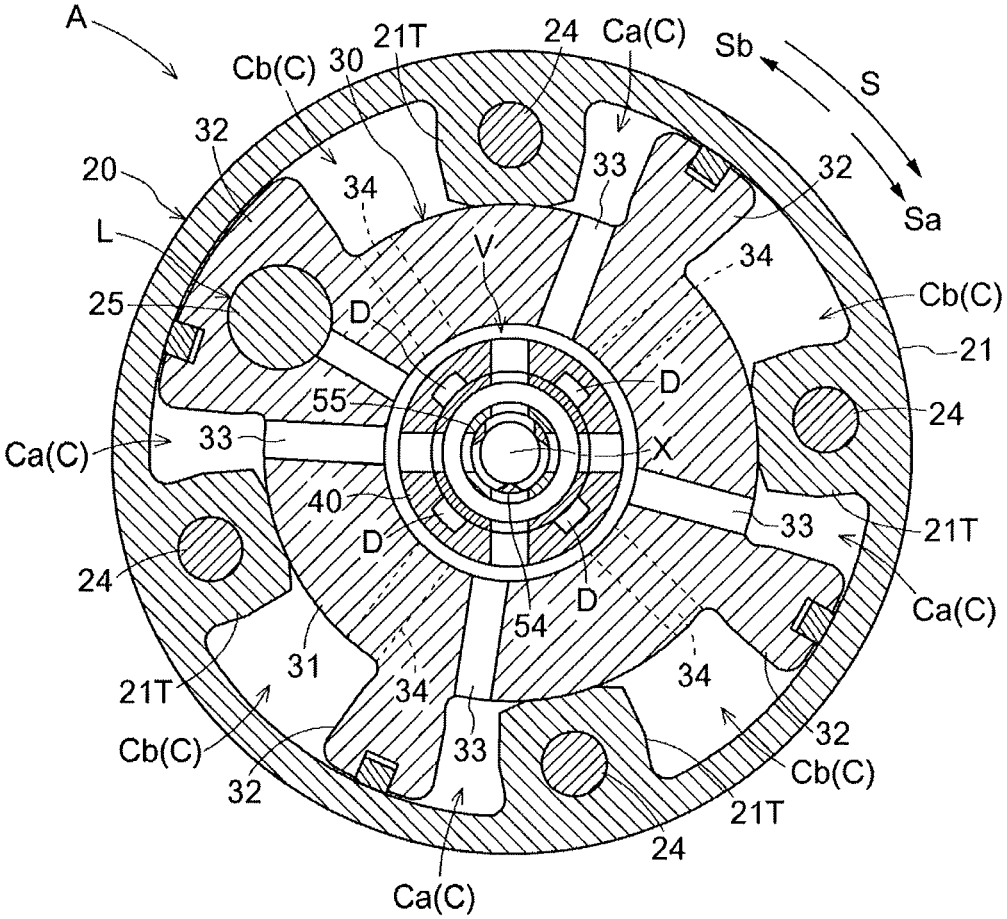
FIG. 2 is a cross sectional view taken along line II-II in FIG. 1.
Figure 3:
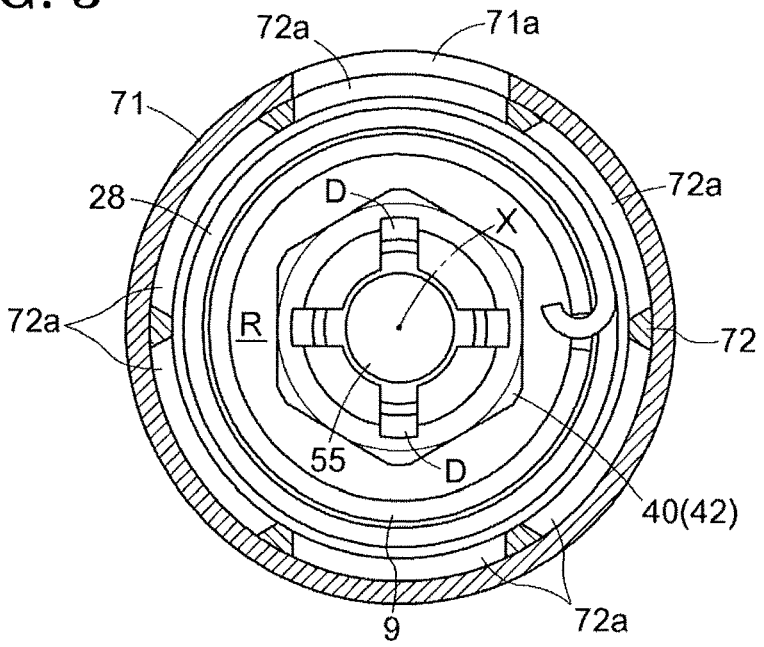
FIG. 3 is a cross sectional view taken along line III-III in FIG. 1.

A basic configuration of a first embodiment will hereunder be explained. As illustrated in FIGS. 1 to 3, a variable valve timing control device A includes an outer rotor 20 serving as a drive-side rotational body, an inner rotor 30 serving as a driven-side rotational body, an electromagnetic control valve V controlling operating oil serving as fluid, and a reservoir R accumulating the operating oil.

The inner rotor 30 (an example of the driven-side rotational body) is coaxially disposed with a rotary axis X of an intake camshaft 5 (i.e., serving as a camshaft), and is connected thereto by a connecting bolt 40 so as to integrally rotate therewith. The outer rotor 20 (an example of the drive-side rotational body) is coaxially disposed with the rotary axis X and synchronously rotates with a crankshaft 1 of an engine E serving as an internal combustion engine. The outer rotor 20 contains the inner rotor 30, and is supported therewith so as to be relatively rotatable therewith.

The electromagnetic control valve V includes an electromagnetic unit Va supported by the engine E so as to be in a positionally fixed state, and a valve unit Vb that is contained in an internal space of the connecting bolt 40.

The electromagnetic unit Va includes a solenoid portion 50, and a plunger 51 that is coaxially disposed with the rotary axis X so as to extend and retract by the drive control of the solenoid portion 50. The valve unit Vb includes a spool 55 that controls the supply and discharge of the operating oil (an example of fluid) and that is coaxially disposed with the rotary axis X.

The protruding amount of the plunger 51 is set by the control of electricity supplied to the solenoid portion 50, and the spool 55 operates in a direction along the rotary axis X in connection with the setting of the protruding amount of the plunger 51. As a result, the operating oil is controlled by the spool 55, the relative rotational phase of the outer rotor 20 and the inner rotor 30 is set, and the control of the opening and closing timing of intake valves 5V is achieved.

The engine E and the variable valve timing control device A will hereunder be explained. The engine E (an example of the internal combustion engine) illustrated in FIG. 1 indicates an engine provided in a vehicle of, for example, an automobile. The engine E contains pistons 3 inside cylinder bores of cylinder blocks 2 arranged at an upper portion, and corresponds to a four-cycle-type engine in which connecting rods 4 connect the pistons 3 and the crankshaft 1. The engine E includes the intake camshaft 5 opening and closing the intake valves 5V, and an exhaust camshaft at the upper portion of the engine E. In the engine E, the rotary axis X of the intake camshaft 5 and the exhaust camshaft is set so as to be laterally or horizontally positioned.

An engine configuration member 10 rotatably supporting the intake camshaft 5 includes a supply flow passage 8 supplying the operating oil from an oil hydraulic pump P driven by the engine E. The oil hydraulic pump P supplies lubricating oil accumulated in an oil pan of the engine E to the electromagnetic control valve V via the supply flow passage 8, the lubricating oil serving as the operating oil (an example of fluid).

A timing chain 7 is wound over an output sprocket 6 provided at the crankshaft 1 of the engine E, and a timing sprocket 22S of the outer rotor 20. Accordingly, the outer rotor 20 synchronously rotates with the crankshaft 1. A sprocket is also provided at a frond end of the exhaust camshaft provided at a discharge side, and is wound with the timing chain 7.

As illustrated in FIGS. 1 and 2, the outer rotor 20 rotates in a drive rotary direction S by the drive force from the crankshaft 1. A direction in which the inner rotor 30 relatively rotates with the outer rotor 20 in the same direction as the drive rotary direction S is referred to as an advanced-angle direction Sa, and the opposite direction thereof is referred to as a retarded-angle direction Sb. In the variable valve timing control device A, a relationship between the crankshaft 1 and the intake camshaft 5 is set so as to enhance an intake compression ratio in response to an increase of a displacement amount when the relative rotational phase is displaced in the advanced-angle direction Sa, and so as to reduce the intake compression ratio in response to the increase of the displacement amount when the relative rotational phase is displaced in the retarded-angle direction Sb.

In the first embodiment, the variable valve timing control device A includes the intake camshaft 5. Alternatively, the variable valve timing control device A may include the exhaust camshaft or may include both the intake camshaft 5 and the exhaust camshaft.

As illustrated in FIGS. 1 and 2, the outer rotor 20 includes an outer rotor main body 21, a front plate 22, and a rear plate 23 which are integrally fixed by plural fixing bolts 24. The timing sprocket 22S is provided at an outer circumference of the front plate 22. An annular member 9 is fitted in an inner circumference of the front plate 22. The annular member 9, an inner rotor main body 31, and the intake camshaft 5 are integrally provided by a bolt head portion 42 (i.e., serving as a head portion) of the connecting bolt 40 that is press-fitted to the annular member 9.

The outer rotor 20 and the inner rotor 30 will hereunder be explained. As illustrated in FIG. 2, the outer rotor main body 21 is integrally provided with plural protrusions 21T protruding inwardly in a radial direction. The inner rotor 30 includes the columnar inner rotor main body 31 that is closely in contact with the protrusions 21T of the outer rotor main body 21, and, for example, four vane portions 32 protruding outwardly in the radial direction from the outer circumference of the inner rotor main body 31 so as to be in contact with the inner circumferential surface of the outer rotor main body 21.

As such, the outer rotor 20 contains the inner rotor 30, and plural fluid pressure chambers C each is provided at the outer circumference of the inner rotor main body 31 at a middle position of the protrusions 21T disposed next to each other in a rotational direction (that is, the fluid pressure chamber C is sandwiched by the protrusions 21T disposed next to each other in the rotational direction). The fluid pressure chambers C each is defined by the vane portion 32 to include an advanced-angle chamber Ca and a retarded-angle chamber Cb. Moreover, the inner rotor 30 is provided with advanced-angle passages 33 communicating with the advanced-angle chambers Ca, respectively, and retarded-angle passages 34 communicating with the retarded-angle chambers Cb, respectively.

As illustrated in FIG. 1, a torsion spring 28 is provided over the outer rotor 20 and the annular member 9. The torsion spring 28 assists a relative rotational phase (hereinafter referred to as a relative rotational phase) of the outer rotor 20 and the inner rotor 30 to be displaced in the advanced-angle direction Sa by applying biasing force of the torsion spring 28 from a most-retarded-angle phase in the advanced-angle direction Sa.

As illustrated in FIGS. 1 and 2, the variable valve timing control device A includes a lock mechanism L maintaining the relative rotational phase of the outer rotor 20 and the inner rotor 30 in the most-retarded-angle phase. The lock mechanism L includes a lock member 25, a lock spring 26, and a lock recessed portion 23*a*. The lock member 25 is supported so as to be extendable and retractable in the direction along the rotary axis X relative to the single vane portion 32. The lock spring 26 biases the lock member 25 in a protruding direction thereof. The lock recessed portion 23*a* is provided at the rear plate 23. Alternatively, the lock mechanism L may guide the lock member 25 so as to move along the radial direction.

The lock mechanism L comes to be in a lock state where the lock member 25 engages with the lock recessed portion 23*a* by the biasing force of the lock spring 26 when the relative rotational phase reaches the most-retarded-angle phase. The lock mechanism L is unlocked by the action of the pressure of the operating oil acting on the advanced-angle passage 33 to the lock member 25 in an unlock direction.

The connecting bolt 40 will hereunder be explained. As illustrated in FIG. 1, the connecting bolt 40 is provided with the bolt head portion 42 at an outer end portion (left in FIG. 3) of a bolt main body 41 that is entirely formed in a cylindrical shape. An inner space provided in the direction along the rotary axis X is provided inside the connecting bolt 40, and a male screw portion 41S is provided at an outer circumference of an inner end portion (right in FIG. 3) of the bolt main body 41.

As illustrated in FIG. 1, the intake camshaft 5 is provided with a shaft inner space 5R about the rotary axis X, and a female screw portion 5S at an inner circumference of the shaft inner space 5R. The shaft inner space 5R communicates with the supply flow passage 8.

In this configuration, in a state where the bolt main body 41 is provided in the annular member 9, the outer rotor 20, and the inner rotor 30, the male screw portion 41S is threaded on the female screw portion 5S of the intake camshaft 5, and the inner rotor 30 is fixed to the intake camshaft 5 by the rotation of the bolt head portion 42. Accordingly, the annular member 9 and the inner rotor 30 are fittingly fixed to the intake camshaft 5, and the shaft inner space 5R and an inner space of the connecting bolt 40 communicate with each other.

A restriction wall 44 protruding in a direction approaching the rotary axis X is provided at an outer end side of the inner circumferential surface of the inner space of the connecting bolt 40 in a direction along the rotary axis X. Plural (for example, four) drain grooves D as shown in FIG. 2 each is provided along the rotary axis X in a region of the inner circumference of the connecting bolt 40 reaching a distal end from an intermediate position. The operating oil may be discharged by cutout portions that are provided at parts of the restricting wall 44 overlapping the four drain grooves D, respectively.

The bolt main body 41 includes advanced-angle ports 41*a* communicating with the advanced-angle flow passages 33, respectively, and retarded-angle ports 41*b* communicating with the retarded-angle flow passages 34, respectively, from the outer circumferential surface of the bolt main body 41 over the inner space of the bolt main body 41.

The valve unit Vb will hereunder be explained. As illustrated in FIGS. 1 and 2, the valve unit Vb includes a sleeve 53, a fluid supply pipe 54, and the spool 55. The sleeve 53 is fitted into the bolt main body 41 so as to be in closely contact with the inner circumferential surface thereof. The fluid supply pipe 54 is contained in the inner space of the valve unit Vb so as to be coaxial with the rotary axis X. The spool 55 is disposed so as to be slidable in the direction along the rotary axis X in a state of being guided by the inner circumferential surface of the sleeve 53 and by the outer circumferential surface of a cylindrical tube passage portion of the fluid supply pipe 54.

Moreover, the valve unit Vb includes a spool spring 56 biasing the spool 55 in a protruding direction thereof, a check valve CV, and an oil filter 59. An opening plate 57 and a valve plate 58 constitute the check valve CV.

The sleeve 53 is formed in a cylindrical shape about the rotary axis X, and is supported so as to be relatively unrotatable with the connecting bolt 40 by the engagement of plural engaging protrusions protrudingly provided at the outer end (left in FIG. 1) of the sleeve 53 in the direction along the rotary axis X with the restricting wall 44 of the connecting bolt 40. The sleeve 53 includes an advanced-angle side through hole communicating with the advanced-angle port 41*a*, a retarded-angle side through hole communicating with the retarded-angle port 41*b*, and a drain through hole communicating with the drain groove D.

The sleeve 53 is disposed at a position covering the drain groove D to separate the drain groove D from a space where the spool 55 is disposed at the inner surface side of the sleeve 53. An inner end side (right in FIG. 1) of the sleeve 53 is bent so as to be orthogonal to the rotary axis X to include a reception portion receiving the biasing force of the spool spring 56.

The fluid supply pipe 54 is entirely formed in a cylindrical shape and includes plural supply openings sending the operating oil at a distal end side (left in FIG. 1). By the increase of a diameter of a base end portion (right in FIG. 1) of the fluid supply pipe 54, the base end portion is fitted to an inner circumferential surface of the bolt main body 41.

The spool 55 is entirely formed in a cylindrical shape, includes the inner circumference that is externally fitted on the fluid supply pipe 54, and is supported so as to be slidable along the rotary axis X in a state where a pair of land portions provided at an intermediate portion of the spool 55 is internally fitted to the inner circumference of the sleeve 53.

The spool spring 56 biases the spool 55 in a protruding direction thereof, that is, in a direction of the solenoid portion 50 by the biasing force of the spool spring 56. The spool 55 includes an end portion in the protruding side with which the plunger 51 of the solenoid portion 50 is contactable.

In this configuration, when the solenoid portion 50 is not supplied with the electricity, the land portions of the outer end side of the spool 55 come in contact with the restricting wall 44 to maintain an advanced-angle position illustrated in FIG. 1 by the application of the biasing force of the spool spring 56.

In this advanced-angle position, the operating oil is supplied to the advanced-angle chamber Ca via the advanced-angle port 41*a*, and at the same time, the operating oil in the retarded-angle chamber Cb is returned to the retarded-angle port 41*b*, and is discharged from the inner end (the right end portion in FIG. 1) of the spool 55 to the opening of the bolt head portion 42 via the drain groove D. As a result, the relative rotational phase is displaced in the advanced-angle direction Sa.

Specifically, when the spool 55 is set in the advanced-angle position in a state where the lock mechanism L is in the locked state, a part of the operating oil supplied to the advanced-angle chamber Ca is supplied to the lock mechanism L from the advanced-angle flow passage 33, and releases the lock member 25 from the lock recessed portion 23*a* to achieve an unlocking operation.

The spool 55 is pushed by the pressure from the plunger 51 to reach a neutral position by the increase of the electricity supplied to the solenoid portion 50. In the neutral position, because the pair of the land portions close the advanced-angle port 41*a* and the retarded-angle port 41*b* in the neutral position, the operating oil is not supplied or discharged relative to the advanced-angle chamber Ca and the retarded-angle chamber Cb, and therefore, the relative rotational phase is maintained.

By the further increase of the electricity supplied to the solenoid portion 50, the spool 55 is pressed to reach the retarded-angle position by the pressing force from the plunger 51. In this retarded-angle position, the operating oil is supplied to the retarded-angle chamber Cb via the retarded-angle port 41*b*, and at the same time, the operating oil in the advanced-angle chamber Ca is returned to the advanced-angle port 41*a*, and is discharged from the outer circumference of the spool 55 to the opening of the bolt head portion 42 of the connecting bolt 40 via the inner circumference of the restriction wall 44. As a result, the relative rotational phase is displaced in the retarded-angle direction Sb.

The opening plate 57 and the valve plate 58 constituting the check valve CV are made from a metal plate including the same outer diameter, and are disposed so as to be overlapped with each other. The opening plate 57 includes a circular opening portion at a center position thereof about the rotary axis X. Specifically, a spring plate member is used for the valve plate 58.

In this configuration, by being set at one of the advanced-angle position and the retarded-angle position, the spool 55 supplies the operating oil by being away from the valve plate 58 that elastically deforms by the pressure of the operating oil.

On the other hand, in a case where the pressure at a downstream side relative to the check valve CV increases, in a case where the discharge pressure level of the oil hydraulic pump P decreases, or in a case where the spool 55 is set at the neutral position, a valve body of the valve plate 58 is closely in contact with the opening plate 57 by the biasing force to close the opening portion to prevent the backflow of the operating oil.

Figure 4:
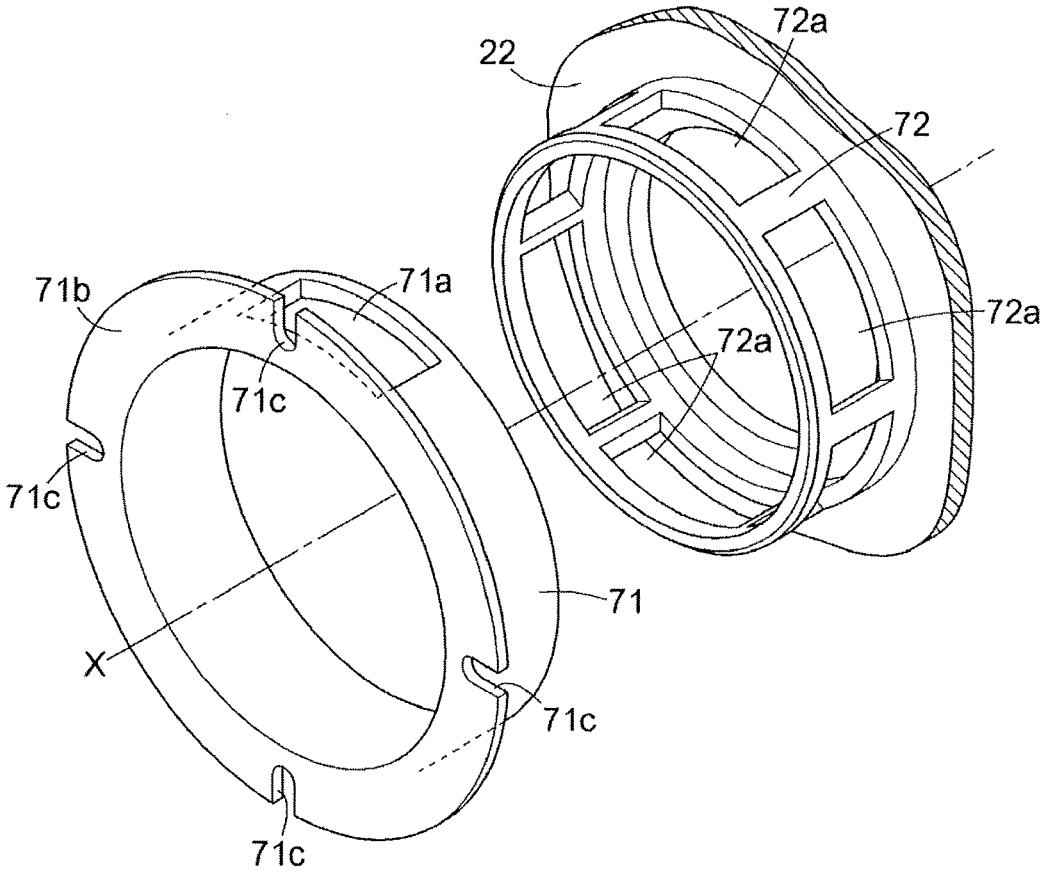
FIG. 4 is an exploded perspective view of a rotational cylindrical body and a non-rotational cylindrical body.

The reservoir will hereunder be explained. As illustrated in FIGS. 1, 3, and 4, the reservoir R includes a non-rotational cylindrical body 71 that is supported at an outer wall portion of the solenoid portion 50 of the electromagnetic unit Va, and a rotational cylindrical body 72 being integrally provided at the front plate 22. The non-rotational cylindrical body 71 and the rotational cylindrical body 72 are coaxially disposed with respect to the rotary axis X, and are disposed such that the rotational cylindrical body 72 is internally fitted to the non-rotational cylindrical body 71.

An outlet 71*a* is provided at an upper position of an outer circumferential portion of the non-rotational cylindrical body 71. Plural through holes 72*a* are provided in outer circumferential portions of the rotational cylindrical body 72 in the radial direction.

Moreover, a flange portion 71*b* is provided at an end portion of a support side (left in FIG. 1) of the non-rotational cylindrical body 71. Plural engagement pins 73 provided in respective plural engagement portions 71*c* arranged at an outer circumference of the flange portion 71*b* are fixed at the solenoid portion 50. The flange portion 71*b* is maintained in a closely contact state relative to an outer wall of the solenoid portion 50 by the biasing force of a retaining spring 74 (an example of a biasing member) externally fitted to each of the plural engagement pins 73.

In the reservoir R, because the non-rotational cylindrical body 71 and the rotational cylindrical body 72 are disposed such that the inner circumferential surface of the non-rotational cylindrical body 71 and the outer circumferential surface of the rotational cylindrical body 72 are slightly in contact with each other, the operating oil is inhibited from leaking from a gap between the non-rotational cylindrical body 71 and the rotational cylindrical body 72 when the rotational cylindrical body 72 rotates. Because the flange portion 71*b* of the non-rotational cylindrical body 71 is closely in contact with the outer wall of the solenoid portion 50 by the biasing force of the plural retaining springs 74, the operating oil is inhibited from leaking at the closely contact part of the flange portion 71*b* and the outer wall of the solenoid portion 50.

In this configuration, forming the rotational cylindrical body 72 so as to include an axis having high precision on a basis of the rotary axis X is relatively easy. On the other hand, enhancing the precision of axis of the non-rotational cylindrical body 71 is not easy. Accordingly, the opening width of each of the plural engagement portions 71*c* is set larger than the outer diameter of the engagement pin 73 to rotate the rotational cylindrical body 72 in a state where the outer circumferential surface of the rotational cylindrical body 72 is slightly in contact with the inner circumferential surface of the non-rotational cylindrical body 71.

Accordingly, in a case where the axis of the rotational cylindrical body 72 and the axis of the non-rotational cylindrical body 71 do not match with each other when assembling, the non-rotational cylindrical body 71 slightly displaces in a direction orthogonal to the rotary axis X so as to contact the outer circumferential surface of the rotational cylindrical body 72 to the inner circumferential surface of the non-rotational cylindrical body 71 in response to the rotation of the rotational cylindrical body 72, and therefore, the axis of the non-rotational cylindrical body 71 is positioned by automatic alignment.

In the reservoir R, the operating oil discharged from the opening of the bolt head portion 42 is accumulated in a reservoir space, and the operating oil is discharged in a state of being overflown because the liquid surface of the operating oil reaches the outlet 71*a* set to a level or to a position higher than the opening of the bolt head portion 42. Accordingly, the operating oil is provided at a sufficiently higher position than the opening of the bolt head portion 42 of the connecting bolt 40, and the opening of the bolt head portion 42 is maintained in a state of being always in contact with the operating oil.

The function of the reservoir R will hereunder be explained. In this configuration, in a case where the control is operated by the electromagnetic control valve V in a state where the oil amount of the operating oil supplied to the variable valve timing control device A from the oil hydraulic pump P largely decreases, for example, immediately after the startup of the engine E, the relative rotational phase is displaced by the action of, for example, the cam fluctuation torque in a state where the operating oil is almost not supplied to one of the advanced-angle chamber Ca and the retarded-angle chamber Cb.

In this case, because the volume of the other of the advanced-angle chamber Ca and the retarded-angle chamber Cb increases, the negative pressure is acted. Even in a case where the negative pressure is acted, the operating oil is sucked to one of the advanced-angle chamber Ca and the retarded-angle chamber Cb on which the negative pressure is acted because the operating oil accumulated in the reservoir R is in contact with the opening of the bolt head portion 42.

As a result, even in a case where the oil amount of the operating oil supplied from the oil hydraulic pump P largely decreases, the air is not sucked into the advanced-angle chamber Ca and the retarded-angle chamber Cb, and the advanced-angle chamber Ca and the retarded-angle chamber Cb are maintained in a state of being filled with the operating oil. Accordingly, the targeted relative rotational phase is achieved promptly in a state where the oil pressure level of the operating oil reaches an appropriate value without generating unusual noise by the vane portion 32 coming in contact with the inner wall of the fluid pressure chamber C.

A second embodiment will hereunder be explained. The disclosure may configure as below other than the aforementioned first embodiment. Components having the same function described in the first embodiment are marked with the same reference numerals.

Figure 5:
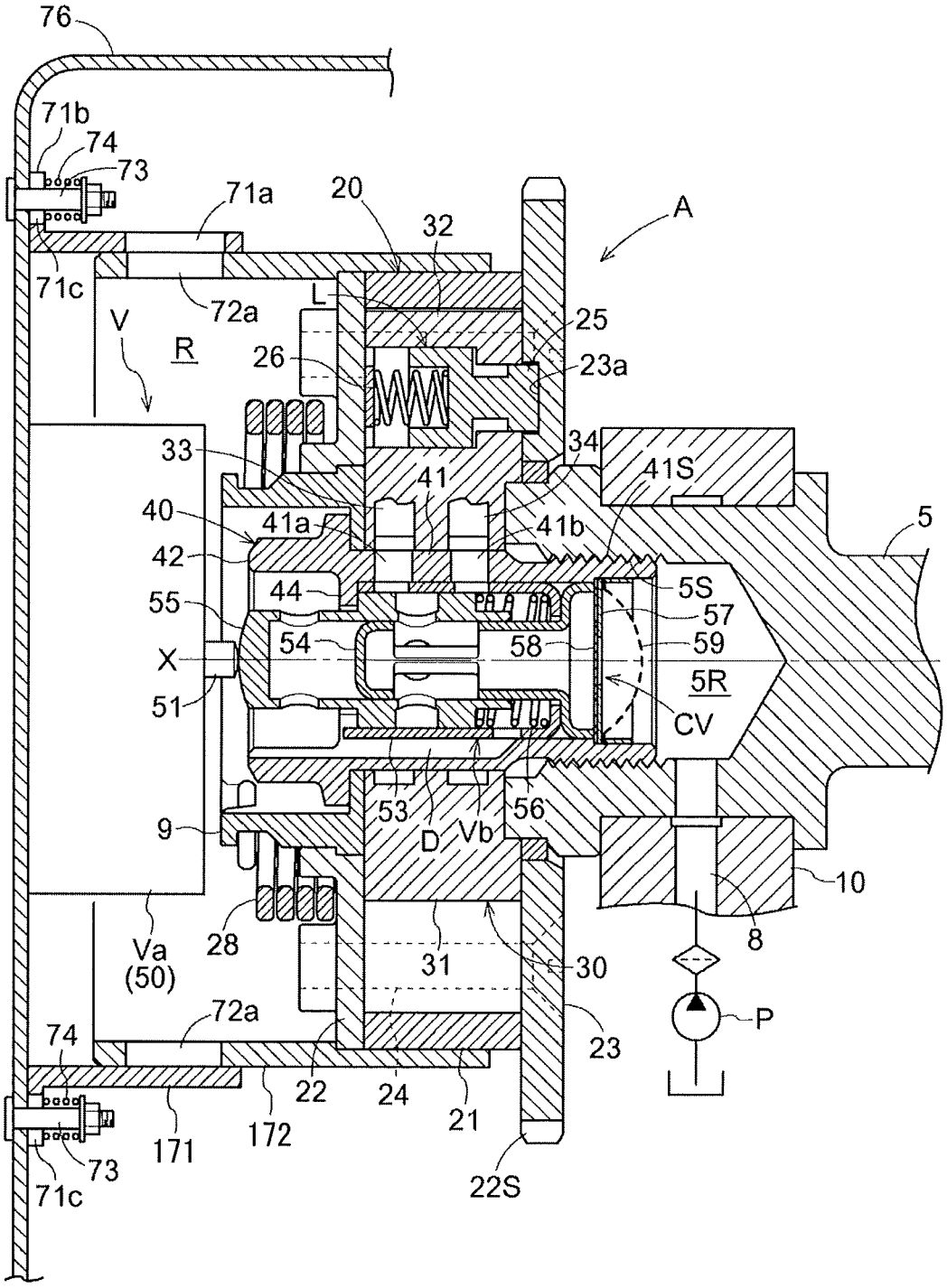
FIG. 5 is a cross sectional view illustrating a configuration of a variable valve timing control device according to a second embodiment.

As illustrated in FIG. 5, the reservoir R includes a non-rotational cylindrical body 171 supported at an inner surface of a chain case 76 serving as a wall body, and a rotational cylindrical body 172 supported at the outer circumference of the outer rotor 20 so as to be fitted thereon.

In the second embodiment, the non-rotational cylindrical body 171 is supported by the chain case 76, which is different from the first embodiment. In the second embodiment, as described in the first embodiment, the flange portion 71*b* is provided at the end portion of the support side (left in FIG. 5) of the non-rotational cylindrical body 171, the engagement pins 73 provided in the plural engagements 71*c* disposed at the outer circumference of the flange portion 71*b* are fixed to the chain case 76, and the flange portion 71*b* is maintained in a closely contact state with the chain case 76 by the biasing force of the retaining spring 74 (an example of the biasing member) externally fitted to each of the plural engagement pins 73.

Accordingly, in a configuration of the second embodiment, in a case where the axis of the rotational cylindrical body 172 and the axis of the non-rotational cylindrical body 171 do not match with each other when assembling, the non-rotational cylindrical body 171 slightly displaces in the direction orthogonal to the rotary axis X in response to the rotation of the rotational cylindrical body 172, and therefore, the axis of the non-rotational cylindrical body 171 is positioned by automatic alignment.

According to the configuration of the second embodiment, even in a state where the oil amount of the operating oil supplied from the oil hydraulic pump P largely decreases, the air is not sucked into the advanced-angle chamber Ca and the retarded-angle chamber Cb, and the advanced-angle chamber Ca and the retarded-angle chamber Cb are maintained in a state of being filled with the operating oil.

Specifically, according to the second embodiment, because an inner end side (a side close to the intake camshaft 5) of the rotational cylindrical body 172 is fittingly fixed to the outer circumferential surface of the outer rotor 20, the variable valve timing control device A does not have to be modified, and may include a simple configuration.

Figure 6:
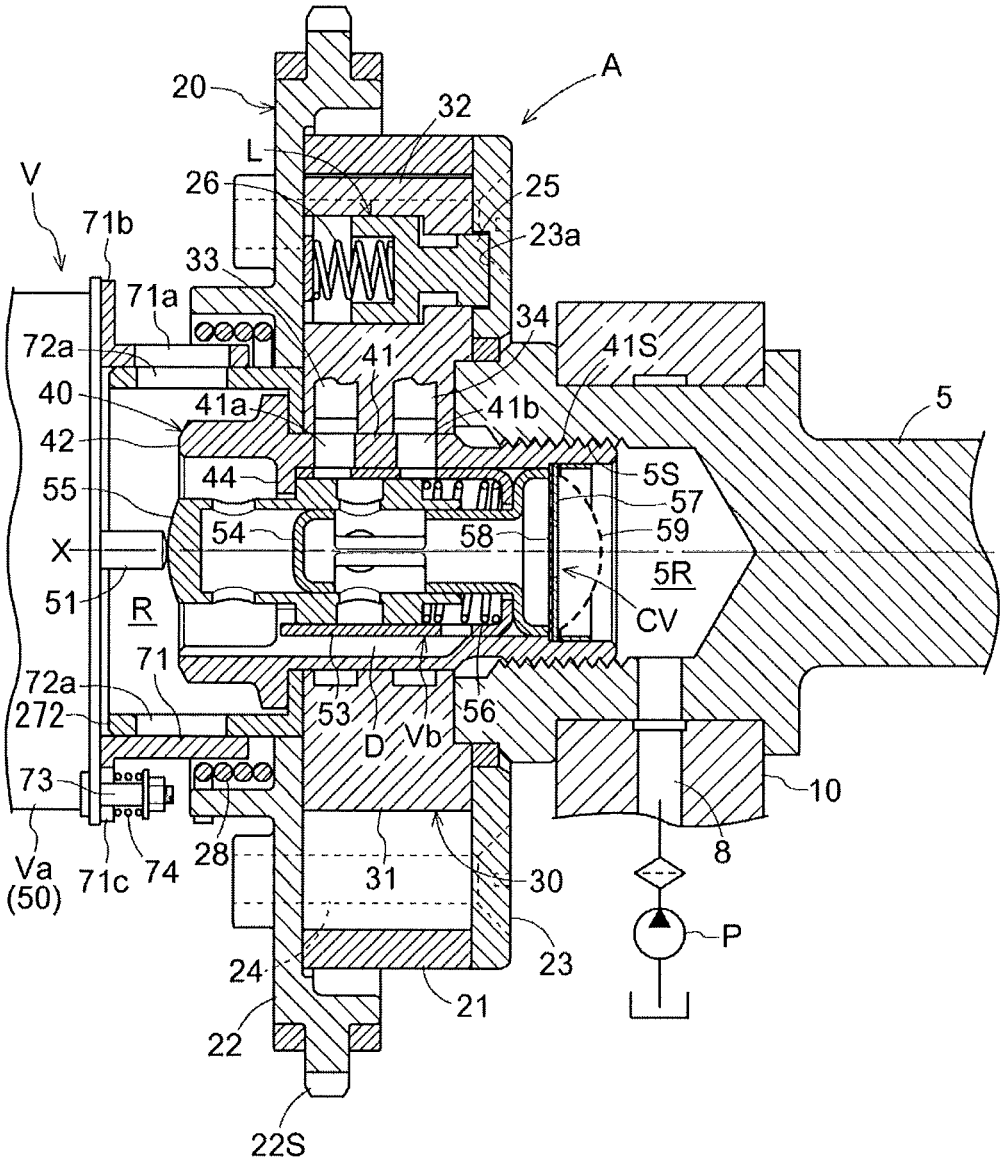
FIG. 6 is a cross sectional view illustrating a configuration of a variable valve timing control device according to a third embodiment.

A third embodiment will hereunder be explained. As illustrated in FIG. 6, the reservoir R includes the non-rotational cylindrical body 71 supported on the outer wall portion of the solenoid portion 50 of the electromagnetic unit Va, and a rotational cylindrical body 272 supported by the connecting bolt 40 at a front surface side of the variable valve timing control device A.

In the third embodiment, the rotational cylindrical body 272 is supported on the inner rotor 30 by the connecting bolt 40, which is different from the first and second embodiments. In the third embodiment, similar to the first and second embodiments, the flange portion 71*b* is provided at the end portion of the support side (left in FIG. 6) of the non-rotational cylindrical body 71, the engagement pins 73 being provided in the respective plural engagement portions 71*c* arranged at the outer circumference of the flange portion 71*b* are fixed to the solenoid portion 50, and the flange portion 71*b* is maintained in a close contact state with the outer wall of the solenoid portion 50 by the biasing force of the retaining spring 74 (an example of the biasing member) externally fitted to each of the plural engagement pins 73.

Thus, also in the third embodiment, in a case where the axis of the rotational cylindrical body 272 and the axis of the non-rotational cylindrical body 71 do not match with each other when assembling, the non-rotational cylindrical body 71 slightly displaces in the direction orthogonal to the rotary axis X in response to the rotation of the rotational cylindrical body 272, and therefore, the axis of the non-rotational cylindrical body 71 is positioned by automatic alignment.

According to the configuration of the third embodiment, even in a case where the oil amount of the operating oil supplied from the oil hydraulic pump P largely decreases, the air is not sucked into in the advanced-angle chamber Ca and the retarded-angle chamber Cb, and the advanced-angle chamber Ca and the retarded-angle chamber Cb are maintained in a state of being filled with the operating oil.

In the third embodiment, one end of the torsion spring 28 is engaged with the support portion of the front plate 22, and the other end of the torsion spring 28 is engaged with the non-rotational cylindrical body 71.

Figure 7:
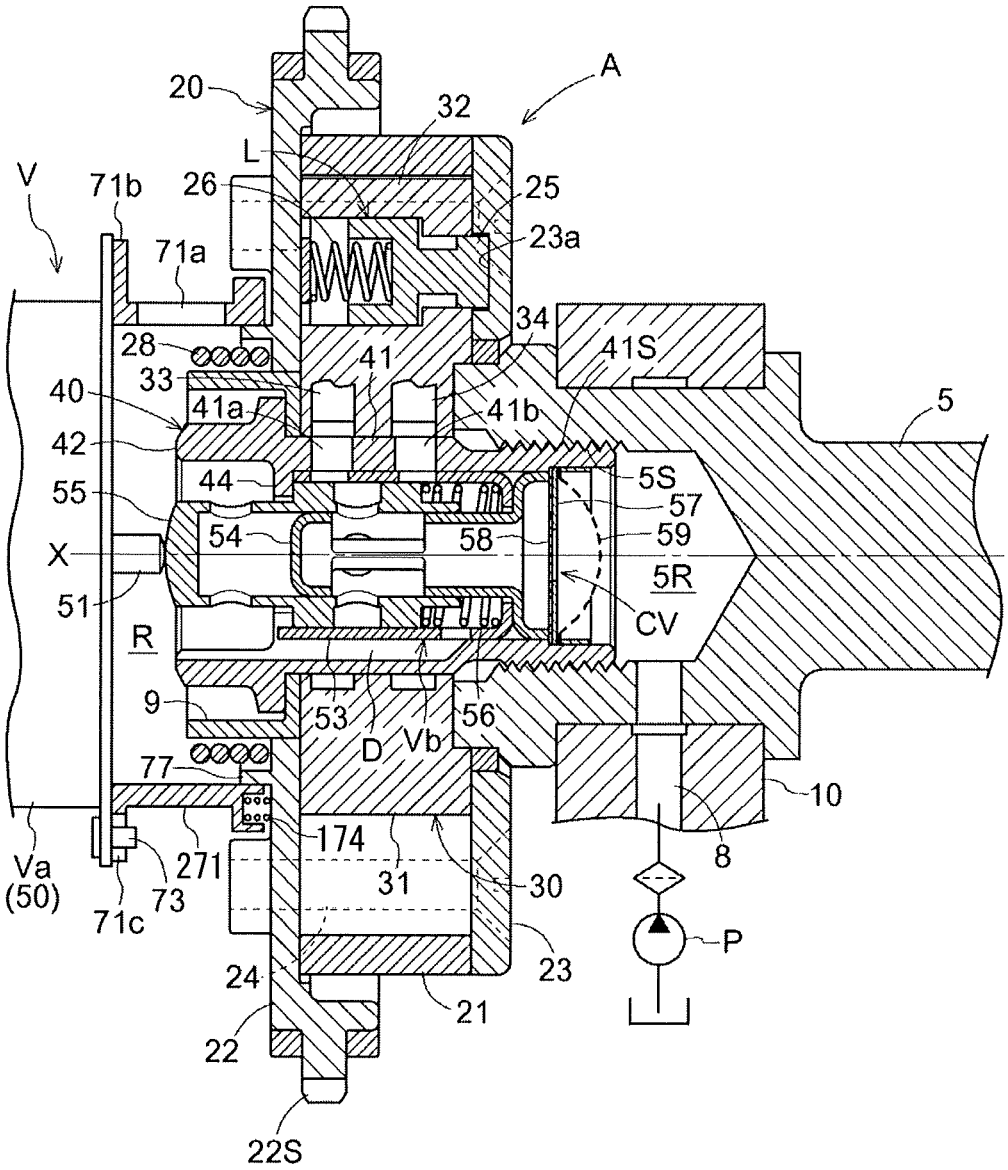
FIG. 7 is a cross sectional view illustrating a configuration of a variable valve timing control device according to a fourth embodiment.

A fourth embodiment will hereunder be explained. As illustrated in FIG. 7, the reservoir R includes a non-rotational cylindrical body 271 supported at the outer wall portion of the solenoid portion 50 of the electromagnetic unit Va. In the fourth embodiment, the rotational cylindrical body 72 is not provided, which is different from the first, second, and third embodiments.

In the fourth embodiment, the outlet 71*a* is provided at the outer circumferential portion of the non-rotational cylindrical body 271, and the operating oil is inhibited from leaking by the contact of the inner circumference of a protruding end of the non-rotational cylindrical body 271 with an outer circumferential surface of a cylindrical seal body 77 provided at the front plate 22.

In the fourth embodiment, the flange portion 71*b* is provided at the end portion of the support side (left in FIG. 7) of the non-rotational cylindrical body 271, and the engagement pins 73 being provided in the respective plural engagement portions 71*c* arranged at the flange portion 71*b* are fixed to the solenoid portion 50, and plural retaining springs 174 (an example of the biasing member) are disposed between the non-rotational cylindrical body 271 and the front plate 22 so as to closely contact the flange portion 71*b* to the outer wall of the solenoid portion 50.

Accordingly, also in the fourth embodiment, in a case where the axis of the seal body 77 and the axis of the non-rotational cylindrical body 71 do not match with each other when assembling, the non-rotational cylindrical body 71 slightly displaces in the direction orthogonal to the rotary axis X in response to the rotation of the seal body 77, and therefore, the axis of the non-rotational cylindrical body 71 is positioned by automatic alignment.

According to the configuration of the fourth embodiment, even in a case where the oil amount of the operating oil supplied from the oil hydraulic pump P largely decreases, the air is not sucked into the advanced-angle chamber Ca and the retarded-angle chamber Cb, and the advanced-angle chamber Ca and the retarded-angle chamber Cb are maintained in a state of being filled with the operating oil.

Figure 8:
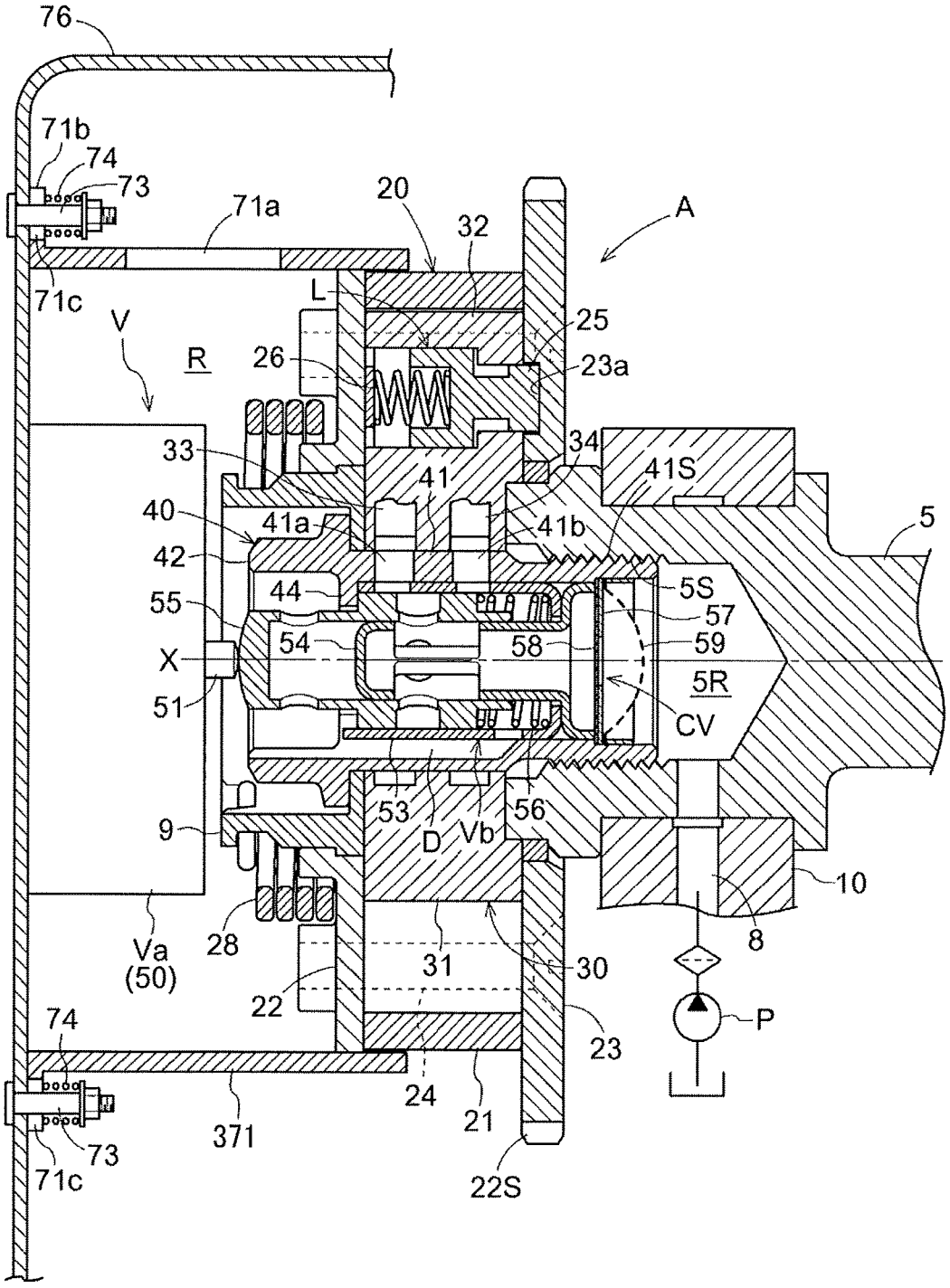
FIG. 8 is a cross sectional view illustrating a configuration of a variable valve timing control device according to a fifth embodiment.

A fifth embodiment will hereunder be explained. As illustrated in FIG. 8, the reservoir R includes a non-rotational cylindrical body 371 being supported at the inner surface of the chain case 76 serving as the wall body. In the fifth embodiment, the rotational cylindrical body 72 is not provided, which is different from the first, second, and third embodiments.

In the fifth embodiment, the outlet 71*a* is provided at the outer circumferential portion of the non-rotational cylindrical body 371, and the operating oil is inhibited from leaking by the contact of the protruding end of the non-rotational cylindrical body 371 with the outer circumferential surface of the front plate 22.

In the fifth embodiment, the flange portion 71*b* is provided at the end portion of the support side (left in FIG. 8) of the non-rotational cylindrical body 71, and the engagement pins 73 being provided in the respective plural engagement portions 71*c* arranged at the outer circumference of the flange portion 71*b* are fixed to the chain case 76. The flange portion 71*b* is maintained in a closely contact state with the chain case 76 by the biasing force of the retaining spring 74 (an example of the biasing member) externally fitted to each of the engagement pins 73.

Accordingly, also in the fifth embodiment, in a case where the axis of the outer circumferential surface of the front plate 22 and the axis of the non-rotational cylindrical body 371 do not match with each other when assembling, the non-rotational cylindrical body 371 slightly displaces in the direction orthogonal to the rotary axis X in response to the rotation of the front plate 22, and therefore, the axis of the non-rotational cylindrical body 371 is positioned by automatic alignment.

According to the configuration of the fifth embodiment, even in a case where the oil amount of the operating oil supplied from the oil hydraulic pump P largely decreases, the air is not sucked into the advanced-angle chamber Ca and the retarded-angle chamber Cb, and the advanced-angle chamber Ca and the retarded-angle chamber Cb are maintained in a state of being filled with the operating oil.

Regarding industrial applicability, the disclosure can be used for a variable valve timing control apparatus that includes an advanced-angle chamber and a retarded-angle chamber.

According to the aforementioned embodiments, the variable valve timing control device includes the drive-side rotational body (the outer rotor 20) rotating synchronously with the crankshaft (1) of the internal combustion engine (the engine E), the driven-side rotational body (the inner rotor 30) being coaxially disposed with the rotary axis (X) of the drive-side rotational body (the outer rotor 20) and rotating integrally with the camshaft (5), the connecting bolt (40) being coaxially disposed with the rotary axis (X) and connecting the driven-side rotational body (the inner rotor 30) to the camshaft (5), the valve unit (Vb) including the spool (55) being disposed at the inner space of the connecting bolt (40) and supplying and discharging the fluid to and from the advanced-angle chamber (Ca) and the retarded-angle chamber (Cb) that are disposed between the drive-side rotational body (the outer rotor 20) and the driven-side rotational body (30), the valve unit (Vb) discharging the fluid from the opening of the head portion (the bolt head portion 42) of the connection bolt (40) when the spool (55) controls the fluid; and the reservoir (R) being coaxially disposed with the rotary axis (X) that is positioned laterally, the reservoir (R) accumulating the fluid discharged from the opening of the head portion (the bolt head portion 42) from which the fluid is configured to be sucked.

According to the characteristic configuration, the fluid discharged from the opening of the connection bolt 40 is accumulated in the reservoir R. After the fluid is accumulated in the reservoir R, in a case where the relative rotational phase of the outer rotor 20 and the inner rotor 30 displaces in a state where the fluid is not sufficiently supplied, or in a case where the negative pressure is generated at one of the advanced-angle chamber Ca and the retarded-angle chamber Cb, the fluid accumulated in the reservoir R is sucked into one of the advanced-angle chamber Ca and the retarded-angle chamber Cb. Accordingly the air is not sucked inside of one of the advanced-angle chamber Ca and the retarded-angle chamber Cb. In the configuration, because the fluid discharged from the opening of the bolt head portion 42 of the connection bolt 40 is accumulated in the reservoir R, an exclusive flow passage for supplying the fluid to the reservoir R does not have to be provided. Accordingly, even in a case where the negative pressure is acted on the opening to which the valve discharges the fluid, the external air is not sucked in, and contact noise by the vane portion 32 is inhibited from being generated. Furthermore, in the configuration, even in a case where the amount of the fluid accumulated in the reservoir R is not sufficiently provided, or, for example, in a case where the engine E stops and the fluid leaks from the advanced-angle chamber Ca and the retarded-angle chamber Cb, the fluid may be sucked into the advanced-angle chamber Ca and the retarded-angle chamber Cb that are disposed lower than the liquid surface of the fluid accumulated in the reservoir R. Accordingly, the contact noise by the vane portion 32 may be inhibited from being generated.

According to the aforementioned embodiments, the reservoir (R) includes the non-rotational cylindrical body (71, 171, 271, 371) that is formed in a cylindrical shape, that is formed at the area surrounding the rotary axis (X), and that is unrotatable. The non-rotational cylindrical body (71, 171, 271, 371) includes the outlet (71*a*) discharging the fluid at a level higher than the opening of the head portion (the bolt head portion 42).

Accordingly, the fluid discharged from the opening is accumulated in the reservoir R, and in a case where the liquid surface of the fluid accumulated in the reservoir R reaches the outlet 71*a*, the fluid is discharged in a state of being overflown, and the opening of the bolt head portion 42 can be always in contact with the fluid, and at the same time, the excessive amount of fluid does not have to be accumulated.

According to the aforementioned embodiments, the reservoir (R) includes the rotational cylindrical body (72, 172, 272) being formed in a cylindrical shape and coaxial with the rotary axis (X), being formed with plural through holes (72*a*) at the outer circumferential portion, integrally rotating with one of the drive-side rotational body (the outer rotor 20) and the driven-side rotational body (the inner rotor 30), and being internally fitted to the non-rotational cylindrical body (71, 171) so as to be relatively rotatable with each other.

The non-rotational cylindrical body 71, 171 may relatively easily perform the closing operation because the outer end side of the non-rotational cylindrical body 71, 171 is supported to a fixation body. However, for example, a sealing structure is required to inhibit the fluid from leaking between the inner end side of the non-rotational cylindrical body 71, 171 and the front plate 22 of the variable valve timing control device A. On the other hand, in a configuration in which the rotational cylindrical body 72, 172, 272 is internally fitted to the non-rotational cylindrical body 71, 171, because the inner end of the rotational cylindrical body 72, 172, 272 may be connected to one of the outer rotor 20 and the inner rotor 30, the fluid at the part may be inhibited from leaking. That is, because the reservoir R includes a dual structure of the non-rotational cylindrical body 71, 171 and the rotational cylindrical body 72, 172, 272, the sealing structure for inhibiting the fluid from leaking may be simplified or even does not have to be provided.

According to the aforementioned embodiments, the variable valve timing control device (A) further includes the biasing member (the retaining spring 74) applying the biasing force to the non-rotational cylindrical body (171, 371), the biasing force allowing the end portion of the non-rotational cylindrical body (171, 371) to make contact with the wall body (76) disposed at the position away from the head portion (the bolt head portion 42) of the connecting bolt (40) in the direction along the rotary axis (X).

Accordingly, because the non-rotational cylindrical body 171, 371 is in contact with the chain case 76 by the biasing force of the retaining spring 74, the sealing performance at the contact portion may be enhanced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control device, comprising:

a drive-side rotational body rotating synchronously with a crankshaft of an internal combustion engine;

a driven-side rotational body being coaxially disposed with a rotary axis of the drive-side rotational body and rotating integrally with a camshaft;

a connecting bolt being coaxially disposed with the rotary axis and connecting the driven-side rotational body to the camshaft;

a valve unit including a spool being disposed at an inner space of the connecting bolt and supplying and discharging a fluid to and from an advanced-angle chamber and a retarded-angle chamber that are disposed between the drive-side rotational body and the driven-side rotational body, the valve unit discharging the fluid from an opening of a head portion of the connection bolt when the spool controls the fluid; and a reservoir being coaxially disposed with the rotary axis that is positioned laterally, the reservoir accumulating the fluid discharged from the opening of the head portion from which the fluid is configured to be sucked, wherein the reservoir includes a non-rotational cylindrical body that is formed in a cylindrical shape, that is formed at an area surrounding the rotary axis, and that is unrotatable; and the non-rotational cylindrical body includes an outlet discharging the fluid at a level higher than the opening of the head portion.

2. The variable valve timing control device according to claim 1, wherein the reservoir includes a rotational cylindrical body being formed in a cylindrical shape and coaxial with the rotary axis;

being formed with plural through holes at an outer circumferential portion;

integrally rotating with one of the drive-side rotational body and the driven-side rotational body; and being internally fitted to the non-rotational cylindrical body so as to be relatively rotatable with each other.

3. The variable valve timing control device according to claim 1, further comprising:

a biasing member applying a biasing force to the non-rotational cylindrical body, the biasing force allowing an end portion of the non-rotational cylindrical body to make contact with a wall body disposed at a position away from the head portion of the connecting bolt in a direction along the rotary axis.

4. The variable valve timing control device according to claim 2, further comprising:

a biasing member applying a biasing force to the non-rotational cylindrical body, the biasing force allowing an end portion of the non-rotational cylindrical body to make contact with a wall body disposed at a position away from the head portion of the connecting bolt in a direction along the rotary axis.

* * * * *